United States Patent [19]

Kim

[11] Patent Number: 4,601,278

[45] Date of Patent: Jul. 22, 1986

[54] AMMUNITION CARTRIDGE

[76] Inventor: Hyung S. Kim, 11743 Lakewood Blvd., #37, Downey, Calif. 90241

[21] Appl. No.: 508,155

[22] Filed: Jun. 24, 1983

[51] Int. Cl.[4] ..... F41B 11/08; F41B 11/00; F42B 5/02

[52] U.S. Cl. ..... 124/57; 124/70; 124/74; 124/75; 102/440

[58] Field of Search ..... 124/57, 58, 70, 74, 124/75; 102/440, 444

[56] References Cited

U.S. PATENT DOCUMENTS

| | | | |
|---|---|---|---|
| 220,030 | 9/1879 | McGowan | 102/444 |
| 279,539 | 6/1883 | Chamberlain | 124/57 X |
| 1,486,215 | 3/1924 | Zerbee | 124/75 X |
| 2,375,314 | 5/1945 | Mills | 124/57 |
| 3,102,525 | 9/1963 | Englis | 124/57 |
| 3,175,494 | 3/1965 | Turner | 102/440 |
| 3,921,614 | 11/1975 | Fogelgren | 124/75 |
| 4,011,817 | 3/1977 | Ashley | 102/440 |
| 4,159,705 | 7/1979 | Jacoby | 124/75 X |

FOREIGN PATENT DOCUMENTS

| | | | |
|---|---|---|---|
| 139 | 11/1966 | Rep. of Korea | 124/57 |

*Primary Examiner*—Robert A. Hafer
*Assistant Examiner*—D. Neal Muir

[57] ABSTRACT

A bullet is fired from an ammunition cartridge upon piercing a breakaway section in the rear wall of the cartridge to form a gas escape port. The cartridge has one open end in which is seated the bullet and the breakaway section of the rear wall is directly opposite the bullet. A moveable sealing element is adapted to move between two positions. One position seals off the opening in the one end, and the other position is displaced from the opening to allow gas to escape under pressure from the opening. Piston-type element, in response to the housing wall being pierced, stops the flow of gas from this escape port and moves the sealing element from the first to the second position.

18 Claims, 7 Drawing Figures

AMMUNITION CARTRIDGE

BACKGROUND OF THE INVENTION

1. Field of the Invention

This invention relates to ammunition and particularly ammunition cartridges that contain pressurized gas as the means for propelling a bullet held by the cartridge.

2. Background Discussion

It has long been a common practice to use gunpowder which, when ignited, generates gases that propel a bullet. The gunpowder is retained in a cartridge and the bullet is fitted tightly in the open end of the cartridge. When the firing pin strikes the ignition point on the cartridge, the gunpowder explodes, generating gases which propel the bullet from the cartridge.

Some guns instead of using gunpowder propel the bullet by means of pressurized gas, in most instances air. These guns usually contain a chamber which is filled with pressurized air, and then when the gun is fired, the air is released rapidly from the chamber to force the bullet from the barrel of the gun. Generally these guns have had only limited acceptance because of various factors, one of which is that the bullet fired from such a gun does not have an acceptable range or accuracy. Air guns that do approach the accuracy and range of the more conventional guns employing cartridges containing gunpowder are very expensive.

BRIEF DESCRIPTION OF THE INVENTION

I have now invented ammunition which propels a bullet from a cartridge holding it by means of pressurized gas contained within the cartridge. The bullet is seated adjacent a cylinder containing pressurized gas and it is propelled from the cartridge upon the release of the gas. The cartridge contains sealing means which normally are closed to prevent the release of gas from the cylinder. These means open in response to the cartridge being pierced to provide a gas escape port.

The sealing means include a piston which moves axially when the cartridge is pierced. The piston divides the cylinder into two chambers which each contain gas under pressure. The gas pressure is equal initially, but piercing of the cartridge creates a pressure differential which causes the piston to move the sealing means to the open position, causing the bullet to be propelled from the cartridge. The cartridge has at one end an opening and a wall remote from this one end which may be pierced to provide the gas escape port for escaping pressurized gas from the one chamber of the cylinder. Gas escapes almost instantly from the other chamber upon the sealing means moving to the open position. The movable sealing means serve as the means for controlling release of the pressurized gas for propelling the bullet from the cartridge.

The movable sealing means are adapted to move between a first position where it seals off the opening in the one end of the housing and a second position displaced from the opening to allow gas to escape under pressure from the opening. There are means in the housing which, in response to the housing wall being pierced to form the gas escape port, stop the flow of gas from the escape port and move the sealing means from the first position to the second position. Thus substantially all the pressurized gas in the housing exits through the opening in the housing rather than the gas escape port. This gas, being at a very high pressure, impinges against the end of the bullet retained in the cartridge and forces the bullet from the cartridge at a very high velocity. In other words, when the sealing means moves to the second position, the bullet sees gas at very high pressure just as if there was an explosion of gunpowder within the cartridge. The gas pressure in the cylinder normally exceeds 500 pounds per square inch and typically ranges between about 500 and about 1200 pounds per square inch (psi). The heavier the bullet the more pressure required, however. Too much pressure results in loss of control of the direction of flight of the bullet. Too little results in loss of range.

The ammunition of this invention has several advantages. First, because there is no explosion, there is essentially no recoil of the gun using this ammunition. Second, since an explosion does not occur, there is no fire or heat generated when the ammunition is discharged. Consequently, there is no nozzle flame. The lack of a nozzle flame is very desirable for military applications since the location of firing of the gun cannot be traced by observation of the nozzle flame. Moreover, because there is no explosion, heat is not generated and cooling of the gun is not required. The lack of heat and essentially no recoil enables one to make a lighter gun. Third, combustion products are not collected in the barrel of the gun. Therefore cleaning of the gun is either not required or required only infrequently. Fourth, the cartridge of this invention also provides the same power and range as a conventional gun such as a M1 rifle. It has an advantage over conventional guns such as the M1rifle because the range of conventional guns decreases as the gun is heated. Because heating of the gun is avoided using the cartridge of this invention, range is not diminished. Fifth, the cartridge of this invention may also be reused. Therefore it provides a significant cost savings. Sixth, guns using the ammunition of this invention do not require gas recycle for rejecting the cartridge from the firing chamber.

DETAILED DESCRIPTION OF THE DRAWINGS

Figure 1:
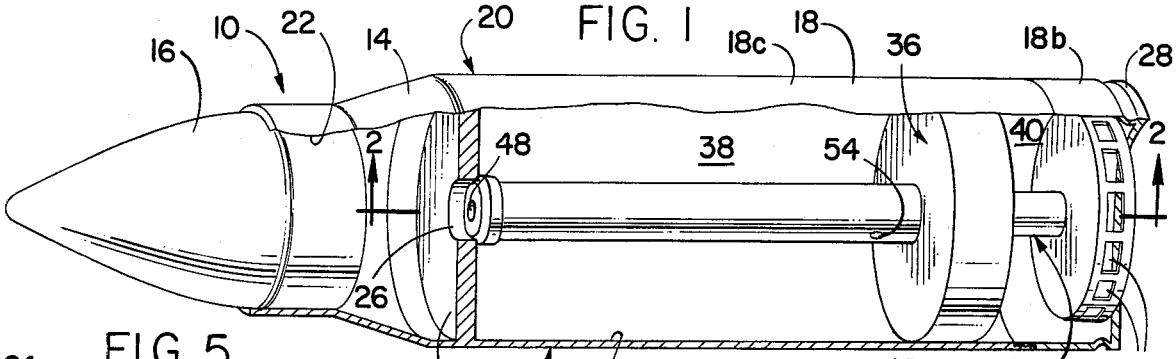
FIG. 1 is a perspective view of the ammunition of this invention with sections broken away.

As shown in FIG. 1, the ammunition 10 of this invention includes a cartridge 12 having a bullet retaining section 14 which holds a bullet 16 and a gas retaining section 18 which contains pressurized gas. The bullet retaining section 14 and gas retaining section 18 have a common exterior wall 20. This wall 20 tapers inwardly to form a restricted annular opening 22 into which the bullet 16 is force fitted.

Figure 2:
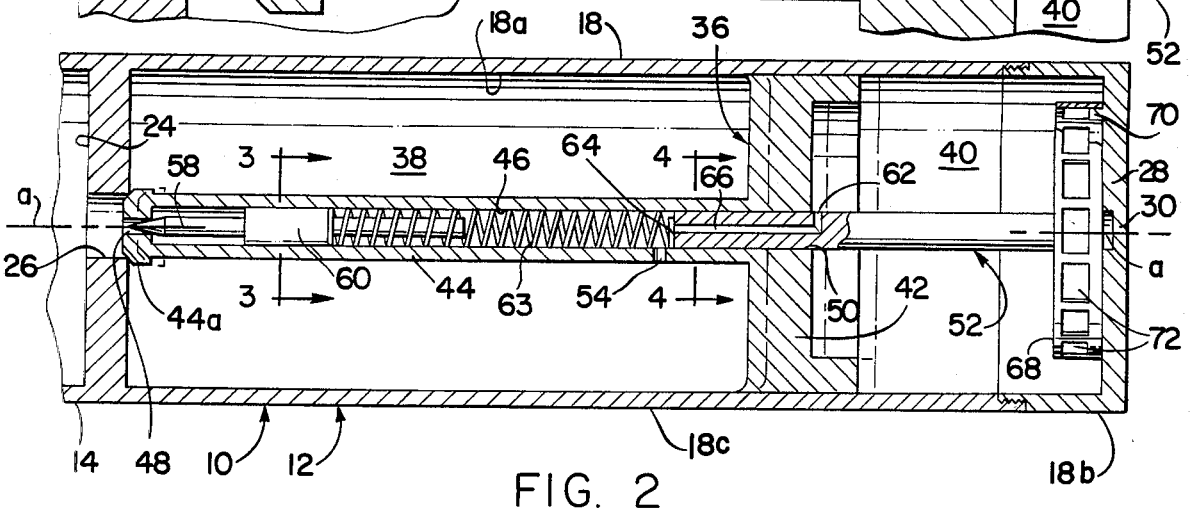
FIG. 2 is a cross-sectional view taken along line 2—2 of FIG. 1 with the piston of the cartridge in the closed position.
Figure 7:
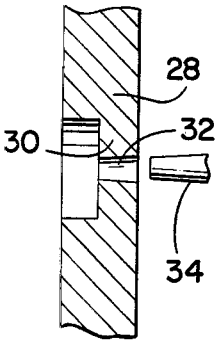
FIG. 7 is an enlarged fragmentary view of the rear wall of the cartridge showing the breakaway section of this wall pierced by the firing pin of a gun using the ammunition of this invention.

As best shown in FIG. 2, the gas containing section 18 includes a hollow cylinder 18*a* having at one end an interior wall 24 with a central annular opening 26 therein. At the opposed end of the cylinder 18*a* is an external rear wall 28 with a central breakaway section 30 which may be pierced to provide a gas escape port 32 (FIG. 7) for the pressurized gas contained within the cylinder. As shown by FIG. 7, the rear wall 28 is pierced by the firing pin 34 of the gun using the ammunition to form the gas escape port 32. The cylinder 18*a* is in two parts, 18*b* and 18*c*, with the rear part 18*b* containing the breakaway section 30 screwed onto the forward part. The parts 18*b* and 18*c* are threaded so they may be screwed together.

Figure 5:
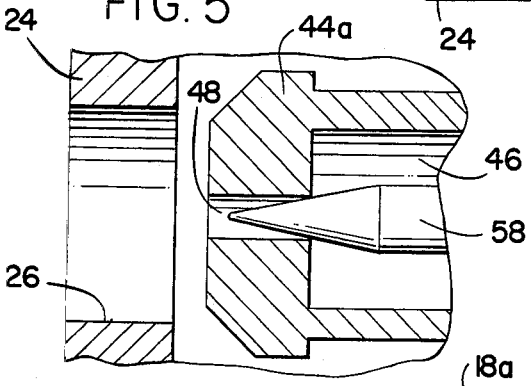
FIG. 5 is an enlarged fragmentary view of the end of the piston remote from the piston head displaced from the opening in the cartridge.

Contained within the cylinder 18*a* is a piston 36. The piston head 42 divides the cylinder 18*a* into two chambers, 38 and 40. The piston 36 is adapted to move along the longitudinal axis a of the cylinder 28*a* between two different positions, a closed position and an open position. In the closed position (shown in solid lines in FIG. 2) the tapered end 44*a* of the stem 44 of the piston fits snug into the annular opening 26 in the internal wall 24 of the cylinder 18*a*. In the open position (shown in dotted lines in FIG. 2) the end 44*a* of the stem 44 is displaced inwardly so that pressurized gas contained within the chamber 38 will flow through the opening 26 and force the bullet from the bullet retaining section. The position of the stem end 42*a* with the piston in the open position is best shown in FIG. 5.

The piston head 44 fits snug against the inner wall of the cylinder 18*a* and the stem 44 is coaxial with the longitudinal axis a of the cylinder. The stem 44, being hollow, provides a passageway 46 which has a gas entry port 48 at one end and an opening 50 in its other end. A plug member 52 fits snug within the opening 50 and prevents gas from escaping through this opening. The stem 44 has a first chamber fill port 54 along its side. Gases flowing along the passageway 46 flow through this fill port 54 into the chamber 38.

Figure 3:
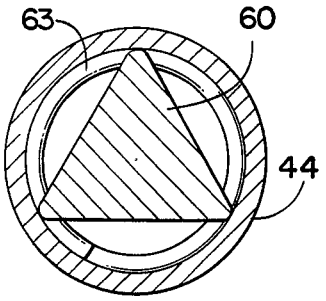
FIG. 3 is a cross-sectional view taken along line 3—3 of FIG. 2.

There is a one-way valve 56 disposed in the passageway 46 adjacent the annular opening 26 in the wall 24, and it is disposed between this opening 26 and the fill port 54. The valve 56 includes a needle 58 whose tip is inserted into the gas entry port 48 in the stem 44. As shown in FIG. 3, an intermediate portion of the needle 58 has an enlarged member 60 of triangular cross-section, and a coiled spring 63 seated between the enlarged member 60 and the end of the plug member 52 urges the pointed tip of the valve 56 into the gas entry port 48. This valve configuration allows gas to flow past the needle and by the enlarged member 60 when the valve is opened by depressing needle 58. The air is forced under pressure through the gas entry port 48 into the passageway 46 to fill the chambers 38 and 40. How these chambers are filled will be explained in greater detail below.

Figure 6:
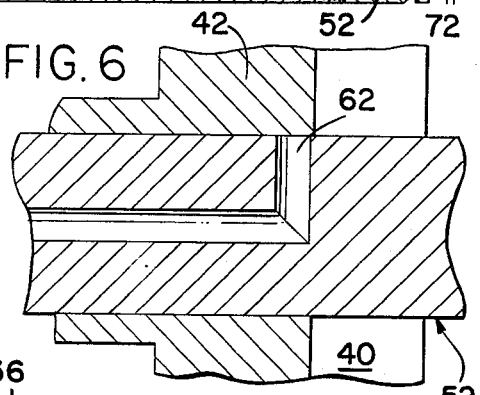
FIG. 6 is an enlarged fragmentary view of the head of the piston closing off the fill port in the plug member.
Figure 4:
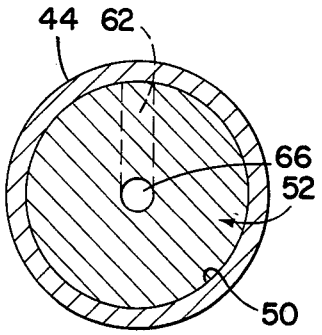
FIG. 4 is a cross-sectional view taken along line 4—4 of FIG. 2.

The plug member 52 is stationary and it has a fill port 62 in its side. In the end of the plug member 52 inserted into the passageway 46 is a second gas entry port 64. There is a channel 66 (FIGS. 2 and 4) extending between this gas entry port 64 and the fill port 62, placing the two chambers 38 and 40 in communication with each other. The second fill port 62 is adjacent the piston head 42 when the piston 36 is in the closed position, and when the piston element is in the open position, it moves to cover this fill port 62 as shown in FIG. 6. The plug member 52 has at its remote end a cylindrical stand 68 which fits over an annular positioning ridge 70 extending inwardly from the back side of the rear wall 28. In the side wall of this stand 68 are a number of windows 72 displaced in equal intervals around the circumference of the stand. These windows 72 allow gas to flow through the stand 68 when the gas escape port 32 is formed in the rear wall 28.

To assemble, with the rear end unscrewed, the piston 36 containing the one-way valve 56 in its hollow stem 44 is inserted into the inside of the cylinder 18*a* so that the tapered end 44*a* of the stem fits within the gas entry port 48. The plug member 52 is then inserted into the open end 50 of the stem and into the passageway 46 until the inserted end of the plug member is just flush with the fill port 54, but does not block it. The coil spring 63 of the one-way valve 56 is biased so that it is forcing the pointed tip of the needle 58 into the gas entry port. The rear end of the cylinder is then screwed into position as shown in FIG. 1 holding the internal components in position.

Next the chambers 38 and 40 are charged with gas, preferably air. This is accomplished by connecting a conventional air pump (not shown) to the gas entry port 48 and inserting its tip into the stem 44 to push the needle 58 inwardly to permit the pressurized air to flow through the passageway 46 and out the one fill port 54 to fill the chamber 38 and through the second gas entry port 64, through the channel 66, and out the second fill port 62 to fill the other chamber 40. The air is forced into these two chambers 38 and 40 until the internal air pressure within these chambers exceeds about 500 psi. The cartridge is now charged with pressurized gas.

Lastly, the bullet 16 is forced into the bullet receiving section 14, as shown in FIG. 1.

Operation

To fire the ammunition 10, it is first placed in a conventional firing chamber of a rifle such as the U.S. Army's M1 rifle. When the trigger of the rifle is pulled, the firing pin 34 pierces the central portion of the breakway section 30 to form the gas escape port 32. The pressurized gas in chamber 40 flows through the windows 72 in the stand 68 and out the escape port 32. Essentially instantaneously, this creates a differential in pressure between chamber 38 and chamber 40. This differential in pressure causes the piston 36 to move axially to the right as shown in FIG. 1 to the open position shown in FIG. 5. In this open position, the piston head covers the fill port 62 as shown in FIG. 6. Thus the gas from the chamber 38 cannot flow into chamber 40. With the piston 30 displaced, the opening 26 is now uncovered by the removal of the tapered end 44*a* of the stem. This allows the gas in chamber 38 to explode from this chamber out the opening. Because of the high pressure of this gas, the bullet is forced at high velocity from the bullet retaining section 14 and out the barrel of the rifle.

When all of the gas from chamber 38 has escaped, the pressure in the two chambers 38 and 40 will again be equal. The cartridge 12 may now be reused by returning the piston 36 to the closed position with the stem end 44*a* in the opening 26 and refilling it with pressurized gas as described above. When the chambers 38 and 40 are again refilled, a bullet is again force fitted into the open end of the bullet retaining section 14. The cartridge is now reloaded and ready for firing.

The above description presents the best mode contemplated of carrying out the present invention. This invention is, however, susceptible to modifications and alternate constructions from the embodiment shown in the drawings and described above. Consequently, it is not the intention to limit this invention to the particular embodiments disclosed. On the contrary, the intention is to cover all modifications and alternate constructions formed within the spirit and scope of the invention as expressed in the appended claims.

What is claimed is:

1. A cartridge comprising:

a generally cylindrical rigid housing having at one end an annular opening in which is lodged a bullet and a first wall remote from said one end which prevents the escape of gas but may be pierced to provide a gas escape port for pressurized gas contained within the housing, and a second wall between said annular opening and the first wall having therein a gas escape opening for the pressurized gas contained within the housing;

movable sealing means, including one way valve means for feeding gas under pressure into the housing, said movable means being adapted to move between a first position where it (seals off) seals the gas escape opening and a second position displaced from the gas escape opening to allow gas to escape under pressure from the gas escape opening; and movable sealing means further comprising means in the housing which, in response to the first wall being pierced to form the gas escape port, limits the flow of gas from the escape port and moves the sealing means from the first position to the second position.

2. The cartridge of claim 1 wherein the sealing means includes means which permits gas to be fed under pressure into the housing while said sealing means is in the first position.

3. The cartridge of claim 1 wherein the movable sealing means includes a piston element which divides the housing into first and second chambers, both of the chambers being filled with pressurized gas at equal pressures prior to the piercing of the housing wall to allow gas to escape.

4. The cartridge of claim 3 wherein the piston element includes a hollow stem having one open end adjacent the opening in the housing and an opposed open end which includes plug means having a channel therein which places the first and second chambers in communication with each other.

5. The cartridge of claim 4 wherein the hollow stem has therein one-way valve means which permits gas to be fed under pressure into the housing while said sealing means is in the first position.

6. The cartridge of claim 1 wherein the housing contains pressurized gas at a pressure exceeding 500 psi.

7. The cartridge of claim 6 wherein the gas pressure is between about 500 and about 1200 psi.

8. A cartridge comprising:

a housing having an open end and an opposed closed end with a breakaway wall therein which may be pierced to provide a gas escape port for pressurized gas contained within the housing;

a piston element within the housing which divides the housing into first and second adjacent chambers and which is adapted to move axially between first and second positions, said piston element having (a) a head member that fits snugly against the inner walls of the housing, and (b) a hollow stem member extending outwardly from the head member and connected thereto, with the end of the stem member furthest from the head member being seated in the open end of the housing to seal said open end when the piston element is in the first position, and being displaced from said open end when the piston element is in the second position, said stem member having a first fill port therein and having opposed open ends on opposite sides of said first fill port to provide a passageway to allow gas to enter the housing;

one-way valve means disposed in the hollow stem adajcent the open end of the housing between the open end and the first fill port, said valve means being in a normally closed position to prevent gas from escaping the housing through the open end of the stem adjacent the open end of the housing; and plug means having a second fill port therein and a channel running from the second fill port through the plug means and terminating in an end in the plug means which is inserted into the end of the stem member nearest the head member, said second fill port being adjacent the head member when the piston element is in the first position and being covered by the head member when the piston element is in the second position.

9. The cartridge of claim 8 wherein both the chambers are filled with pressurized gas at equal pressures prior to the piercing of the breakaway wall.

10. The cartridge of claim 9 wherein the housing in the form of a generally hollow cylinder.

11. The cartridge of claim 9 wherein the closed end of the housing is detachably secured to the remainder of the housing.

12. The cartridge of claim 9 wherein the plug means includes a gas distributor which directs air through the gas escape port when the breakaway wall is pierced.

13. The cartridge of claim 9 wherein the chambers contain pressurized gas at a pressure exceeding 500 psi prior to piercing the breakaway wall.

14. The cartridge of claim 9 wherein the gas pressure is between about 500 and about 1200 psi.

15. Ammunition comprising:

a bullet seated adjacent a cartridge containing pressurized gas, said bullet being propelled from the cartridge when the gas escapes from the cartridge, said cartridge containing means which is normally closed to prevent the release of gas from the cartridge, but in response to the cartridge being pierced, changes position to prevent all the gas from escaping through the point where the cartridge is pierced and simultaneously releases the gas through an opening adjacent the bullet so that the gas impinges against the bullet to force the bullet from the cartridge, said cartridge including a hollow cylinger having at one end a wall with a central annular opening therein and at its opposed end a wall with a central breakaway section which may be pierced to provide a gas escape port for pressurized gas contained within the cylinder;

a piston element within the cylinder which divides the cylinder into first and second adjacent chambers and which is adapted to move along the longitudinal axis of the cylinder between first and second positions, said piston element having (a) a head member that fits snug against the inner walls of the cylinder, and (b) a hollow stem member coaxial with the longitudinal axis of the cylinder and connected to and extending outwardly from the head member and having one end normally seated in the central opening in the cylindral wall when the piston element is in the first position and being displaced to uncover said opening when the piston element is in the second position, said stem member having a first fill port along the side thereof for filling the first chamber with gas and having opposed open ends on opposite sides of the first fill port to provide a passageway to allow gas to enter the cylinder, one way valve means disposed in the hollow stem adjacent the opening in the cylinder wall and disposed between said opening and the first fill port, said valve means comprising needle means coupled to spring means which urge the needle means into the open end of the stem to close and seal this open end so that gas does not escape through said open end, said needle means being movable inwardly against the force of the spring to open said end to allow gas to fill the cylinder, and stationary plug means having a second fill port therein, said plug means having one end inserted into the open end of the stem member nearest the head member and in this end a gas entry port and a channel placing the gas entry port and the second fill port in communication with each other, with the second fill port being adjacent the head member when the piston element is in the first position and being covered by the head member when the piston element is in the second position.

16. The ammunition of claim 15 wherein both the chambers are filled with pressurized gas at equal pressures prior to the piercing of the breakaway wall.

17. The ammunition of claim 16 wherein the chambers contain pressurized gas at a pressure exceeding 500 psi prior to piercing the breakaway wall.

18. The ammunition of claim 17 wherein the gas pressure is between about 500 and about 1200 psi.

* * * * *